US011274679B2

(12) United States Patent
Sun

(10) Patent No.: US 11,274,679 B2
(45) Date of Patent: Mar. 15, 2022

(54) OIL FREE CENTRIFUGAL COMPRESSOR FOR USE IN LOW CAPACITY APPLICATIONS

(71) Applicant: Danfoss A/S, Nordborg (DK)

(72) Inventor: Lin Sun, Tallahassee, FL (US)

(73) Assignee: Danfoss A/S

( * ) Notice: Subject to any disclaimer, the term of this patent is extended or adjusted under 35 U.S.C. 154(b) by 226 days.

(21) Appl. No.: 15/892,872

(22) Filed: Feb. 9, 2018

(65) Prior Publication Data

US 2018/0231006 A1 Aug. 16, 2018

Related U.S. Application Data

(60) Provisional application No. 62/458,761, filed on Feb. 14, 2017.

(51) Int. Cl.

| | |
|---|---|
| ***F04D 29/58*** | (2006.01) |
| ***F25B 31/00*** | (2006.01) |
| ***F04D 25/06*** | (2006.01) |
| ***F04D 17/08*** | (2006.01) |
| ***F04D 17/12*** | (2006.01) |

(Continued)

(52) U.S. Cl.

CPC ..... *F04D 29/5806* (2013.01); *F04D 17/08* (2013.01); *F04D 17/122* (2013.01); *F04D 25/06* (2013.01); *F04D 29/4206* (2013.01); *F04D 29/584* (2013.01); *F25B 31/006* (2013.01); *F04D 29/058* (2013.01)

(58) Field of Classification Search

CPC .. F04D 29/582; F04D 29/584; F04D 29/5853; F04D 25/06; F04D 29/058; F04D 29/4206; F04D 29/5806; F04D 19/028; F04D 17/22; F04D 17/08; F04D 17/122; F25B 31/006

See application file for complete search history.

(56) References Cited

U.S. PATENT DOCUMENTS 3,975,117 A * 8/1976 Carter ..... F04D 1/06 417/370
4,032,312 A 6/1977 Anderson (Continued)

FOREIGN PATENT DOCUMENTS

CN 1222649 A 7/1999
CN 1639466 A 7/2005

(Continued)

OTHER PUBLICATIONS

European Examination Report for European Application No. 18156631.6 dated Nov. 28, 2019.

(Continued)

*Primary Examiner* — Bryan M Lettman

(74) *Attorney, Agent, or Firm* — Carlson, Gaskey & Olds, P.C.

(57) ABSTRACT

A compressor operates within a system having a cooling capacity below 60 tons. The compressor includes a hermetically sealed housing and a drive module and aero module within the housing. The drive module includes a motor, a rotor, and oil free bearings. The aero module has a centrifugal impeller driven by the drive module to compress a working fluid. The compressor is arranged such that the working fluid flows through the drive module before reaching the aero module.

16 Claims, 8 Drawing Sheets

(51) Int. Cl.
*F04D 29/42* (2006.01)
*F04D 29/058* (2006.01)

(56) References Cited

U.S. PATENT DOCUMENTS

| | | | | |
|---|---|---|---|---|
| 5,350,039 | A | 9/1994 | Voss et al. | |
| 5,888,053 | A * | 3/1999 | Kobayashi | F04D 29/4266 417/244 |
| 5,904,471 | A * | 5/1999 | Woollenweber | F02B 37/16 417/307 |
| 6,155,802 | A | 12/2000 | Choi et al. | |
| 6,418,927 | B1 | 7/2002 | Kullik | |
| 6,632,077 | B2 | 10/2003 | Sishtla | |
| 7,646,118 | B2 * | 1/2010 | Yoshida | B25F 5/008 310/60 R |
| 8,156,757 | B2 | 4/2012 | Doty et al. | |
| 8,303,271 | B2 * | 11/2012 | Ikeda | F04B 39/06 417/371 |
| 9,200,643 | B2 | 12/2015 | Gilarranz et al. | |
| 2002/0037225 | A1 | 3/2002 | Chang et al. | |
| 2005/0069434 | A1 * | 3/2005 | Tani | F04D 29/061 417/423.12 |
| 2005/0223737 | A1 | 10/2005 | Conry | |
| 2008/0135635 | A1 | 6/2008 | Deng et al. | |
| 2008/0218015 | A1 | 9/2008 | Weeber et al. | |
| 2010/0209266 | A1 | 8/2010 | Ikeda et al. | |
| 2011/0150628 | A1 * | 6/2011 | Wagner | F04D 29/048 415/1 |
| 2012/0128512 | A1 * | 5/2012 | Vande Sande | H02K 9/06 417/410.1 |
| 2013/0052051 | A1 * | 2/2013 | Clothier | F04D 29/5806 417/366 |
| 2014/0037422 | A1 | 2/2014 | Gilarranz et al. | |
| 2014/0050603 | A1 * | 2/2014 | Hoj | F04D 29/426 417/410.1 |
| 2014/0248141 | A1 * | 9/2014 | Weilenmann | F04D 25/082 415/206 |
| 2015/0167687 | A1 | 6/2015 | Kurihara et al. | |

FOREIGN PATENT DOCUMENTS

| | | | |
|---|---|---|---|
| CN | 101809286 | A | 8/2010 |
| CN | 103429905 | A | 12/2013 |
| EP | 1074746 | | 3/2000 |
| JP | 2000240596 | A | 9/2000 |
| JP | 2000240598 | A | 9/2000 |
| TW | 381145 | B | 2/2000 |
| WO | 199830790 | A2 | 7/1998 |
| WO | 0250481 | A1 | 6/2002 |
| WO | 2003072946 | A1 | 9/2003 |
| WO | 2012145486 | | 10/2012 |
| WO | WO2015122991 | * | 8/2015 |
| WO | 2016003467 | A1 | 1/2016 |

OTHER PUBLICATIONS

Molyneaux, A.K. et al. "Externally Pressurised and Hybrid Bearings Lubricated with R134a for Oil-Free Compressors," International Compressor Engineering Conference Paper 1142, School of Mechanical Engineering, Purdue University, 1996, http://docs.lib.purdue.edu/cgi/viewcontent.cgi?article=2141&context=icec.

Multistack, Water Cooled Centrifugal Chiller, Product Data Catalog for MS-80T1, www.multistack.com.

DTC TG310 Product Page, "Danfoss Turbocor TG310: Oil Free Compressors Using HF01234ze Regrigerant," Danfoss Turbocor, http://airconditioning.danfoss.com/products/compressors/tg/.

Parker, S.A., et al. "Variable-speed Oil-free Centrifugal Chiller with Magnetic Bearings Assessment: George Howard, Jr. Federal Building and U.S. Courthouse, Pine Bluff, Arkansas," Prepared for the General Services Administration by the Pacific Northwest National Laboratory, Nov. 2012, https://www.gsa.gov/cdnstatic/GPG_Mag_Lev_FullReport_508_6-17-13.pdf.

Williamson, David. "Introduction to Danfoss Turbocor Compressors," Retrieved from the Internet: URL:https://www.atic.be/images/3_DANFOSS_david_williamson.pdf. Apr. 14, 2016.

Extended European Search Report for European Application No. 18156631.6-1007, completed Jun. 26, 2018.

CN Official action dated Aug. 9, 2021 for CN Application No. 201810151079.6.

* cited by examiner

OIL FREE CENTRIFUGAL COMPRESSOR FOR USE IN LOW CAPACITY APPLICATIONS

CROSS-REFERENCE TO RELATED APPLICATIONS

This application claims priority to provisional application 62/458,761, filed on Feb. 14, 2017.

BACKGROUND

Centrifugal compressors are known to provide certain benefits such as enhanced operating efficiency and economy of implementation, especially in oil free designs. However, centrifugal compressors are usually reserved for high capacity applications. The benefits of centrifugal compressors have not been realized in low capacity applications in part because centrifugal designs have been complicated (and expensive) to manufacture within smaller housings.

There is a large market for compressors capable of operating at low capacities. For example, many light commercial applications like roof-top air-conditioning include compressors that operate at relatively low capacities. Centrifugal compressors are uncommon in light commercial applications.

SUMMARY

A compressor according to an exemplary aspect of the present disclosure operates within a system having a cooling capacity below 60 tons includes, among other things, a hermetically sealed housing and a drive module and aero module within the housing. The drive module includes a motor, a rotor, and oil free bearings. The aero module has a centrifugal impeller driven by the drive module to compress a working fluid. The compressor is arranged such that a flow path for the working fluid flows through the drive module before reaching the aero module.

In a further non-limiting embodiment of the foregoing compressor, the oil free bearings are magnetic bearings.

In a further non-limiting embodiment of the foregoing compressor, the oil free bearings are gas bearings configured to use a working fluid as lubricant.

In a further non-limiting embodiment of the foregoing compressor, the drive module is cooled by suction gas before the suction gas reaches the impeller inlet.

In a further non-limiting embodiment of the foregoing compressor, the drive module is driven by a variable frequency drive.

In a further non-limiting embodiment of the foregoing compressor, the variable frequency drive can drive the drive module to achieve system cooling capacities of between 15 and 60 tons.

In a further non-limiting embodiment of the foregoing compressor, the sealed housing acts as a heatsink for power components of the variable frequency drive, and the working fluid cools the sealed housing.

In a further non-limiting embodiment of the foregoing compressor, electronics are enclosed in an integrated electronics housing that is part of the hermetically sealed housing.

In a further non-limiting embodiment of the foregoing compressor, the integrated electronics housing is within an exterior housing defined by two end caps and a tube portion of the sealed housing.

A method of manufacturing a centrifugal compressor according to an exemplary aspect of the disclosure comprises disposing a drive module and aero module in a tube, and welding an end cap to one end of the tube to create a hermetically sealed housing.

In a further non-limiting embodiment of the foregoing method, end caps are welded to opposite ends of the tube to create a hermetically sealed housing.

In a further non-limiting embodiment of the foregoing method, the method further includes fastening the aero module to the drive module.

A compressor according to an exemplary aspect of the present disclosure includes, among other things, a drive module within a housing, and first and second aero modules located within the housing and about opposite ends of the rotor. The drive module includes a motor, a rotor, and bearings. The first and second aero modules each have a centrifugal impeller driven by the drive module to compress a working fluid. The compressor is arranged such that a flow path for working fluid flows through the first aero module.

In a further non-limiting embodiment of the foregoing compressor, the compressor is installed in a system having a cooling capacity of less than 60 tons.

In a further non-limiting embodiment of the foregoing compressor, the housing is hermetically sealed housing.

In a further non-limiting embodiment of the foregoing compressor, the bearings are oil free bearings.

In a further non-limiting embodiment of the foregoing compressor, the compressor includes a dedicated cooling circuit for cooling the drive module using a heat exchanger and a diverted portion of the working fluid that flows through the heat exchanger.

In a further non-limiting embodiment of the foregoing compressor, the heat exchanger includes a fluid passage coiled around the drive module.

In a further non-limiting embodiment of the foregoing compressor, the dedicated cooling circuit includes a temperature sensor mounted to the drive module, and a controller. The temperature sensor is configured to produce an output indicative of a temperature of the drive module. The controller is configured to receive an output from the temperature sensor, and to command an adjustment of a pressure regulator based on the output from the temperature sensor.

In a further non-limiting embodiment of the foregoing compressor, a flow path for the working fluid exits the compressor after flowing through the first aero module but before flowing through the second aero module.

DETAILED DESCRIPTION

Figure 1:
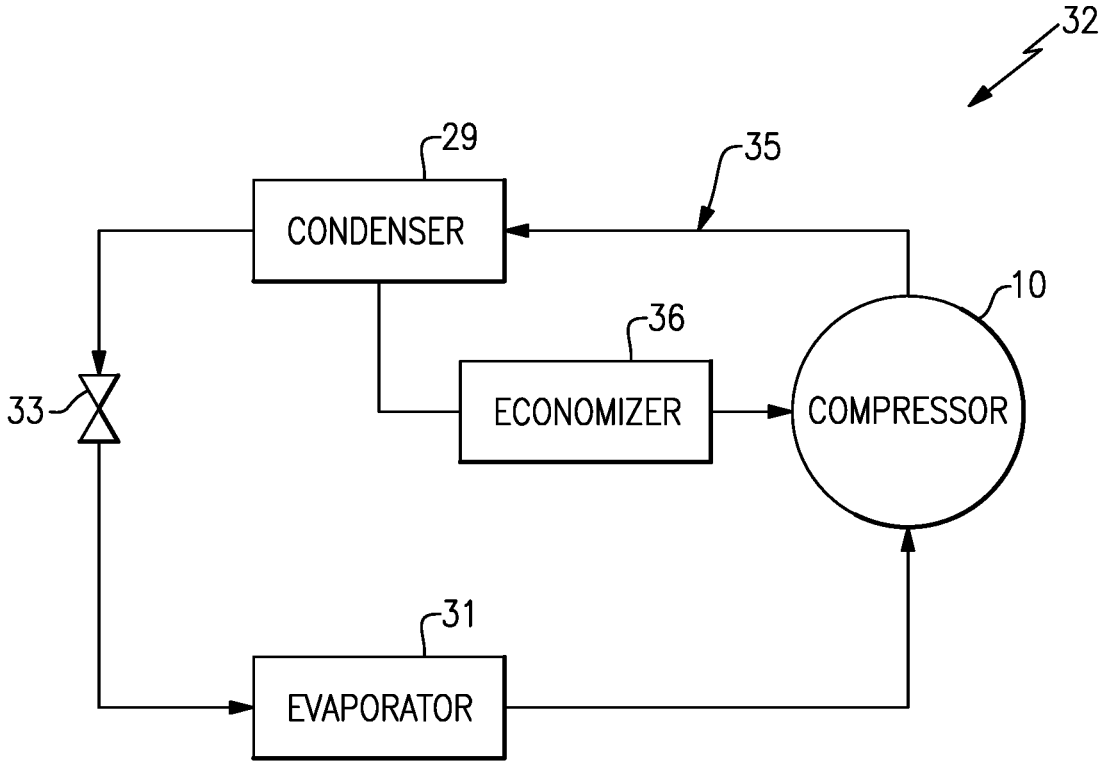
FIG. 1 is a schematic illustration of a refrigerant loop.

The compressors 10 discussed herein are suitable for a wide range of applications. An application contemplated here is a refrigerant system 32, such as represented in FIG. 1. Such a system 32 includes a compressor 10 in a cooling loop 35. The compressor 10 would be upstream of a condenser 29, expansion device 33, and evaporator 31, in turn. A portion of work fluid leaving the condenser 29 may return to the compressor 10 through an economizer 36. Refrigerant flows through the loop 35 to achieve a cooling output according to well known processes. HVAC or refrigerant systems 32 of below 60 tons, or between 15 and 60 tons, are specifically contemplated herein. It should be understood that refrigerant systems 32 are only one example application for the compressors 10 disclosed below.

Figure 2:
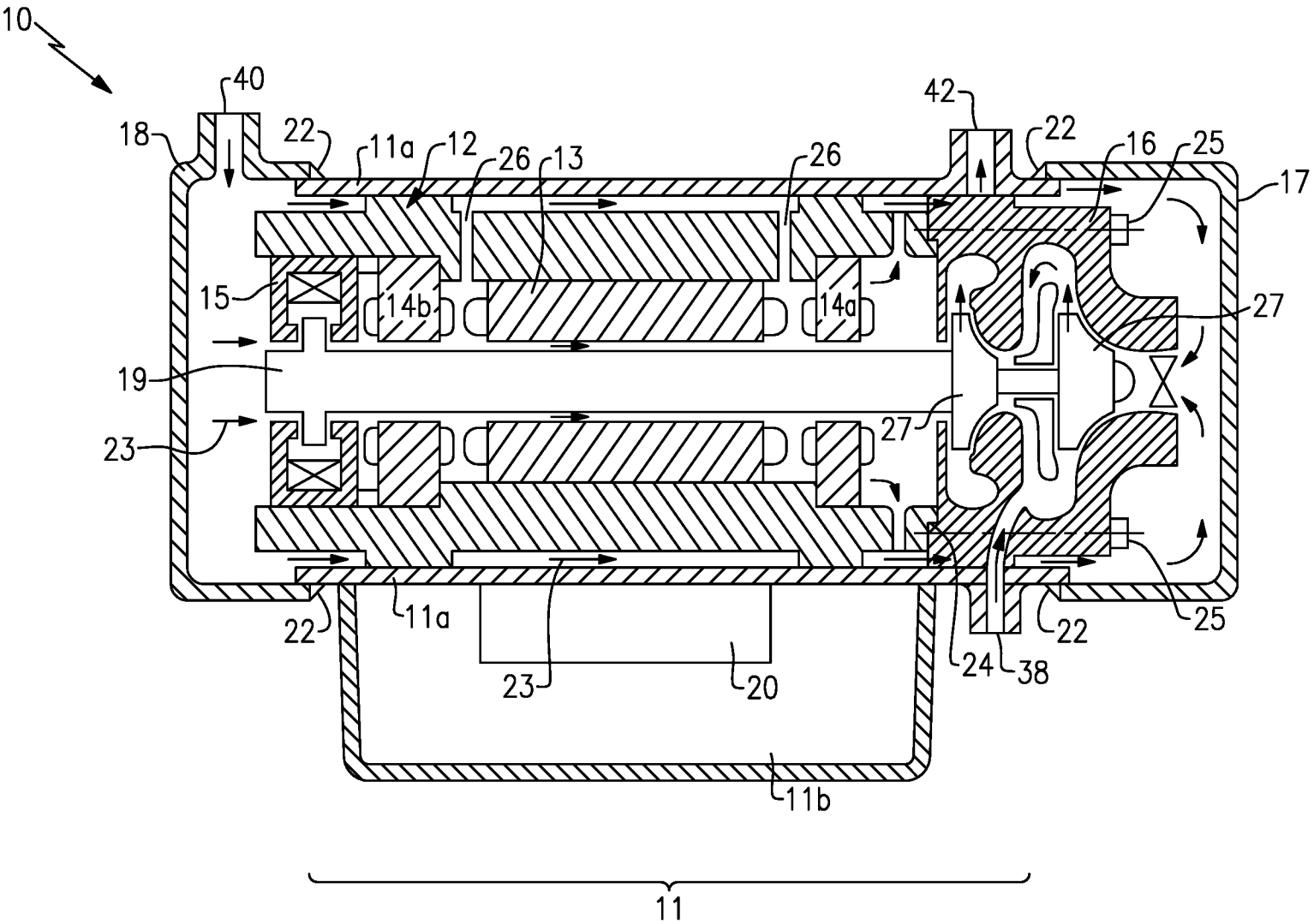
FIG. 2 is an illustration of a centrifugal compressor according to one embodiment.

FIG. 2 illustrates a first embodiment of a centrifugal compressor 10 for systems with relatively low capacities. In one example, the capacity is below 60 tons. In a further embodiment, the capacity is between 15 tons and 60 tons.

The compressor 10 of the present is hermetically sealed. The compressor 10 includes an exterior housing provided by a discharge end cap 17, a suction end cap 18, and a main housing 11. The main housing 11 is attached to the end caps 17, 18 by welds 22, thus rendering the compressor 10 hermetically sealed. In this example, the exterior housing is a three-piece housing and is provided exclusively by the end caps 17, 18, the main housing 11, and the welds 22.

The welds 22 allow one to quickly and economically assemble exterior housing of the compressor 10, especially compared to some prior compressors, which are assembled using fasteners such as bolts or screws.

In this example, the main housing 11 houses all working components of the compressor 10. For example, the main housing 11 includes a drive module 12 having a motor stator 13, rotor 19, radial bearings 14*a*, 14*b*, and a thrust bearing 15. In one embodiment, the drive module 12 is driven by a variable frequency drive.

The main housing 11 also includes an aero module 16, which is an in-line impeller 27 arrangement in the embodiment depicted by FIG. 2. The aero module 16 compresses the working fluid 23 before the working fluid 23 exits the compressor 10 through a discharge port 42. The drive module 12 and aero module 16 are fastened to each other at a close fit point 24 by screws 25. The fixation of the drive module 12 and aero module 16 provides a simple design for the working parts of the compressor 10 that can simply slide into a tube portion 11*a* of the main housing 11, which increases the ease of assembly of the compressor 10. The fastening of the drive module 12 to the aero module 16 allows for modular design of the compressor 10. For example, drive modules 12 and aero modules 16 can be designed separately. Separately designed drive modules 12 and aero modules 16 can be paired and fastened together to suit a given application.

The radial bearings 14*a*, 14*b* and thrust bearing 15 are magnetic or gas bearings, as example, and enable oil free operation of the compressor 10. The working fluid 23 is used as a coolant for the drive module 12. The drive module 12 is cooled as the working fluid 23 flow through fluid paths 26 throughout the drive module 12. If the radial bearings 14*a*, 14*b* or thrust bearing 15 are gas bearings, the working fluid 23 is also used as a lubricant.

In one example, the working fluid 23 flows from a suction port 40 to the aero module 16. Between the suction port 40 and the aero module 16, the fluid paths 26 are dispersed throughout the drive module 12 such that the working fluid passes near each drive module 12 component. In particular, some fluid passes outside the stator 13, while some fluid passes around the shaft 19. The proximity of the fluid paths 26 to components of the drive module 12 allows the working fluid 23 to convectively cool the components of the drive module 12.

Since only one fluid is used as the working fluid 23, coolant, and lubricant, separate distribution networks for each of the working fluid 23, and coolant, are not necessary. A single distribution network carrying working fluid 23, and coolant, further contributes to a compact and simple design. Example working fluids include for such purposes include low global warming potential (GWP) refrigerants, like HFO refrigerants R1234ze, R1233zd, blend refrigerants R513a, R515a, and HFC refrigerant R 134a.

Downstream of the drive module 12, the working fluid 23 reaches the aero module 16. In this example, the aero module 16 has two impellers 27 arranged in a serial arrangement such that fluid exiting the outlet of the first impeller is directed to the inlet of the second impeller. It should be noted, however, that a dual-impeller arrangement is not required in all example. Other centrifugal compressor design variants come within the scope of the disclosure.

Figure 3:
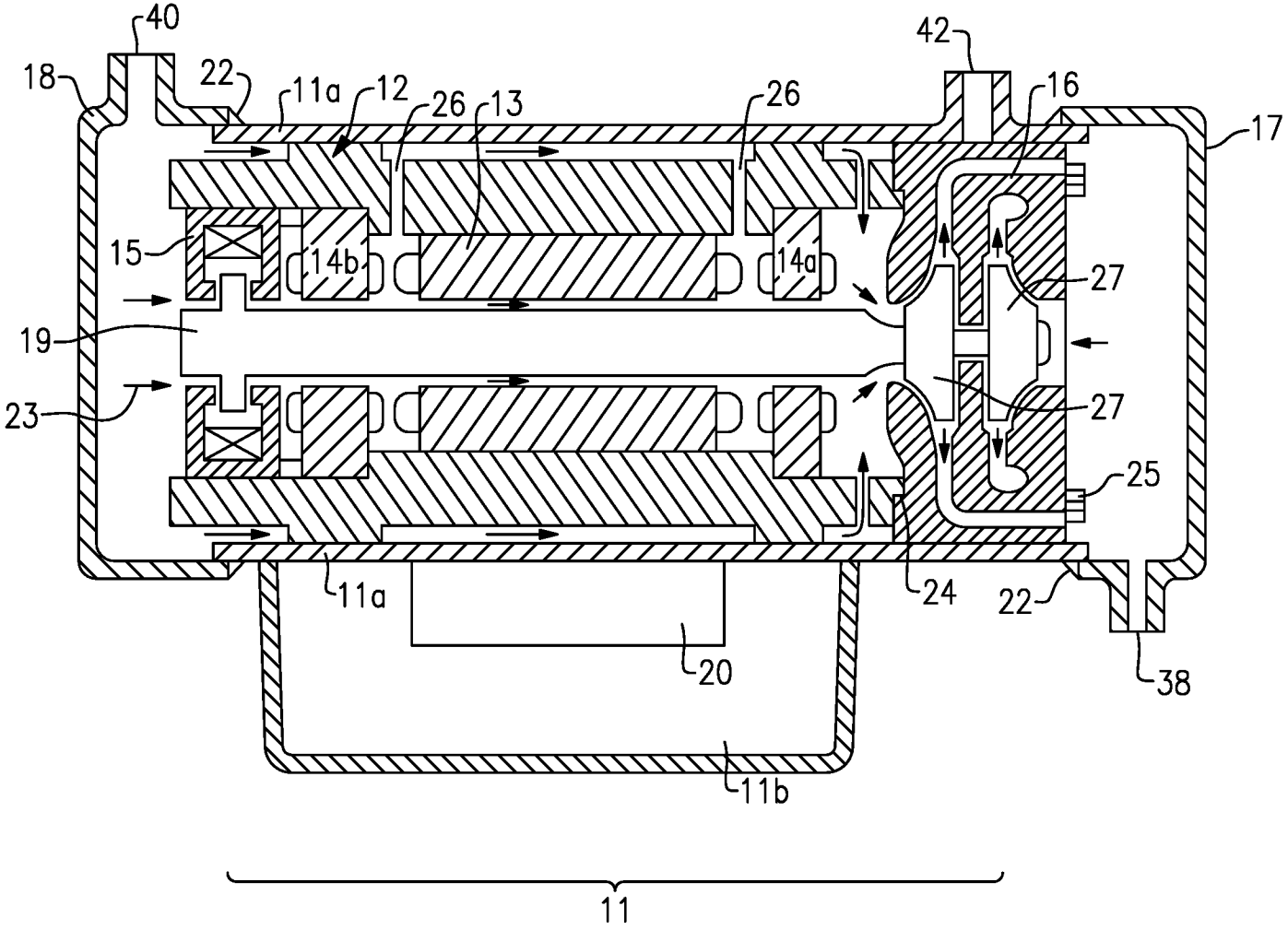
FIG. 3 is an illustration of a centrifugal compressor according to another embodiment.

For example, in another embodiment, which is shown in FIG. 3, the aero module 16 has a close back-to-back impeller 27 configuration. In the in-line impeller 27 arrangement of FIG. 2, the working fluid 23 flows in series from a first impeller to a second impeller, and each impeller is mounted on the shaft 19 and facing the same direction. In the close back-to-back impeller 27 arrangement of FIG. 3, the working fluid 23 enters the aero module 16 from two different directions. The close back-to-back impellers 27 are mounted on the shaft 19 and face in opposite directions. With the close back-to-back configuration, the thrust force from the aero module 16 will be balanced, thus reducing thrust load on the drive module 12.

With two stage compression, an extra flow can be introduced through the economizer port 38 to the second stage inlet to improve the total compressor efficiency.

In either illustrated embodiment, the aero module 16 compresses the working fluid 23 in a known manner. In the case of centrifugal impellers, the known manner of compression involves one or more impellers 27 rotationally accelerating the working fluid 23, then directing the accelerated working fluid 23 against stationary passages which bring the working fluid 23 to a state of relatively lesser velocity and relatively greater pressure. The compressed working fluid 23 exits the compressor 10 through a discharge port 42.

Referring jointly to FIGS. 2 and 3, the compressor 10 has an electronics and power module 20 contained in an integrated electronics compartment 11*b*. In this example, the electronics compartment 11*b* projects outwardly from the tube portion 11*a*.

Figure 4:
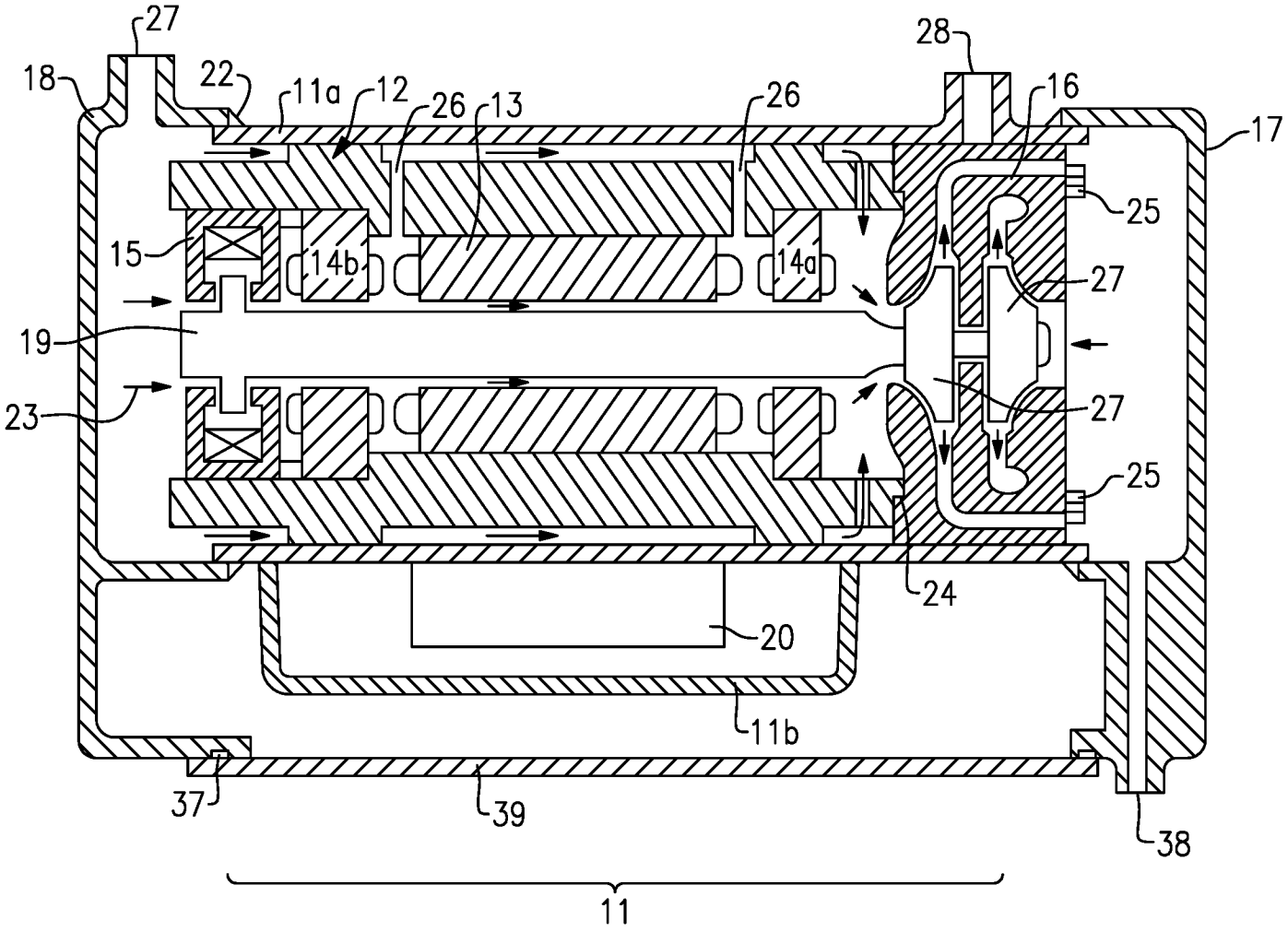
FIG. 4 is an illustration of a centrifugal compressor according to a third embodiment.

In a third embodiment illustrated in FIG. 4, the electronics compartment 11*b* is contained within an enclosure formed by the tube portion 11*a*, discharge end cap 17, and suction end cap 18. The inclusion of the electronics compartment 11*b* within the enclosure of the compressor 10 further simplifies the compressor's 10 design. A seal 37 is used to isolate the electronics compartment 11*b* from the environment, but a cover 39 can be removed for service purposes.

Figure 5:
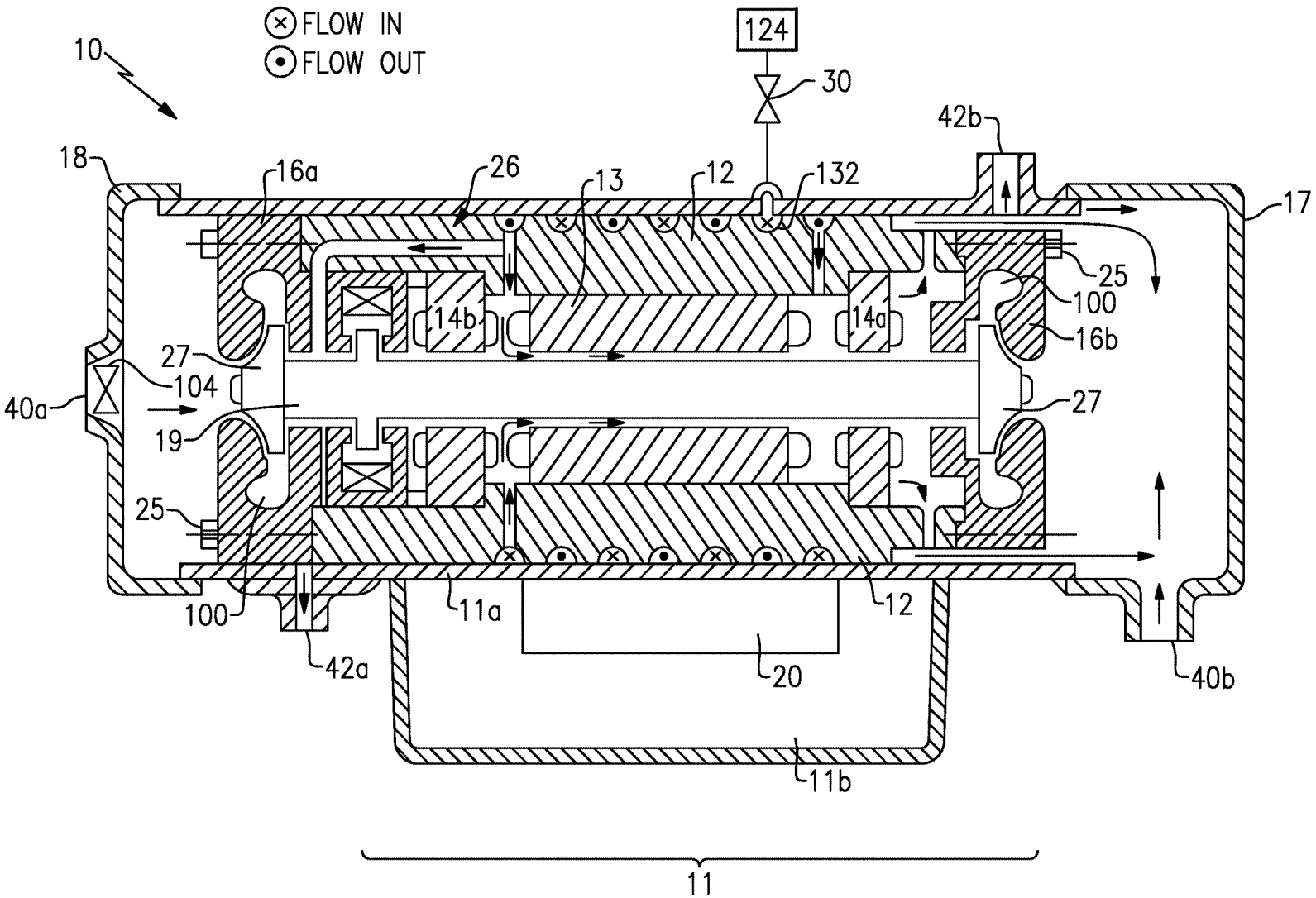
FIG. 5 is an illustration of a centrifugal compressor according to a fourth embodiment.

In a fourth embodiment illustrated in FIG. 5, the impellers 27 are in a distant back-to-back configuration. The distant back-to-back impeller 27 arrangement has first and second aero modules 16*a*, 16*b* at opposite ends of the shaft 19. Both aero modules 16*a*, 16*b* enclose volutes 100 and one of the impellers 27. Gas enters the compressor 10 at a first stage inlet port 40*a*, passes through an inlet valve 104, and exits a first stage outlet port 42*a* after passing through the first aero module 16*a*. Gas from the first stage outlet port 42*a* arrives at the second stage inlet port 40*b*. The second stage inlet port 40*b* also receives gas from an economizer 36, which may be either in line or in parallel with the gas from the first stage outlet port 42*a*. The work fluid finally exits the compressor 10 at an intended degree of compression through second stage outlet port 42*b*.

The two smaller aero modules 16*a*, 16*b* provide more design options for fitting around other components of the compressor 10 than the single aero module 16 of the above described embodiments. The distant back-to-back impeller 27 arrangement thus provides relative freedom in choosing diameters of the shaft 19 and impellers 27 compared to the embodiments described above.

The compressor 10 of FIG. 5 has a dedicated cooling circuit C for the drive module 12. The cooling circuit C diverts a portion of work fluid from a cooling loop, such as the loop 32 of FIG. 1, through a heat exchanger 132. The heat exchanger 132 is illustrated in FIG. 5 as a passage wrapped in a coil around the drive module 12, but be constructed in a variety of other shapes or configurations. FIG. 5 shows an example of the cooling circuit C return to the second stage impeller 27 inlet. In other words, the cooling circuit C return is as the same pressure of the second stage aero module 16*b* suction pressure.

Figure 6:
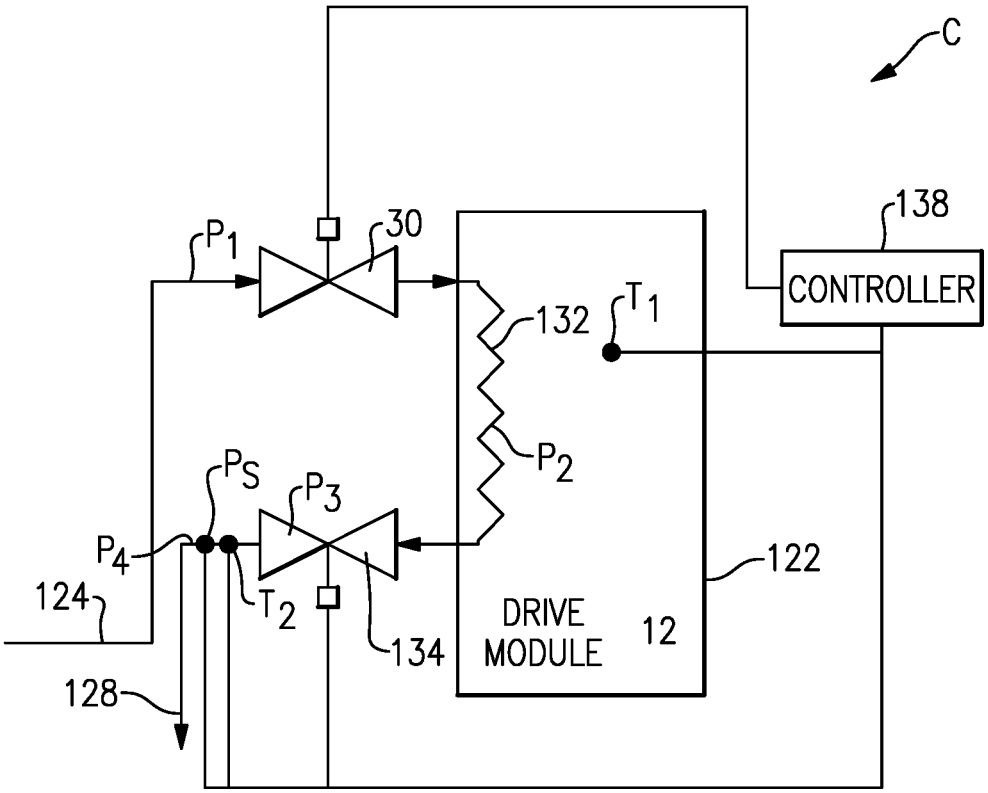
FIG. 6 is a schematic illustration of a dedicated cooling circuit.

FIG. 6 shows another example of a flow diagram for the cooling circuit C. The example cooling circuit C includes an expansion valve 30, a heat exchanger 132 downstream of the expansion valve 30, and a pressure regulator 134 downstream of the heat exchanger 132. In this example, the heat exchanger 132 is mounted around the drive module 12. In one example, the heat exchanger 132 may be a cold plate connected to a housing of the drive module 12.

The expansion valve 30 and the pressure regulator 134 may be any type of device configured to regulate a flow of refrigerant, including mechanical valves, such as butterfly, gate or ball valves with electrical or pneumatic control (e.g., valves regulated by existing pressures). In the illustrated example, the control of the expansion valve 30 and pressure regulator 134 is regulated by a controller 138, which may be any known type of controller including memory, hardware, and software. The controller 138 is configured to store instructions, and to provide those instructions to the various components of the cooling circuit C, as will be discussed below.

During operation of the refrigerant loop 32, in one example, refrigerant enters the cooling circuit C from the condenser 129 through a diverted passage 124. At $P_1$, the fluid is relatively high temperature, and in a liquid state. As fluid flows through the expansion valve 30, it becomes a mixture of vapor and liquid, at $P_2$.

Figure 7:
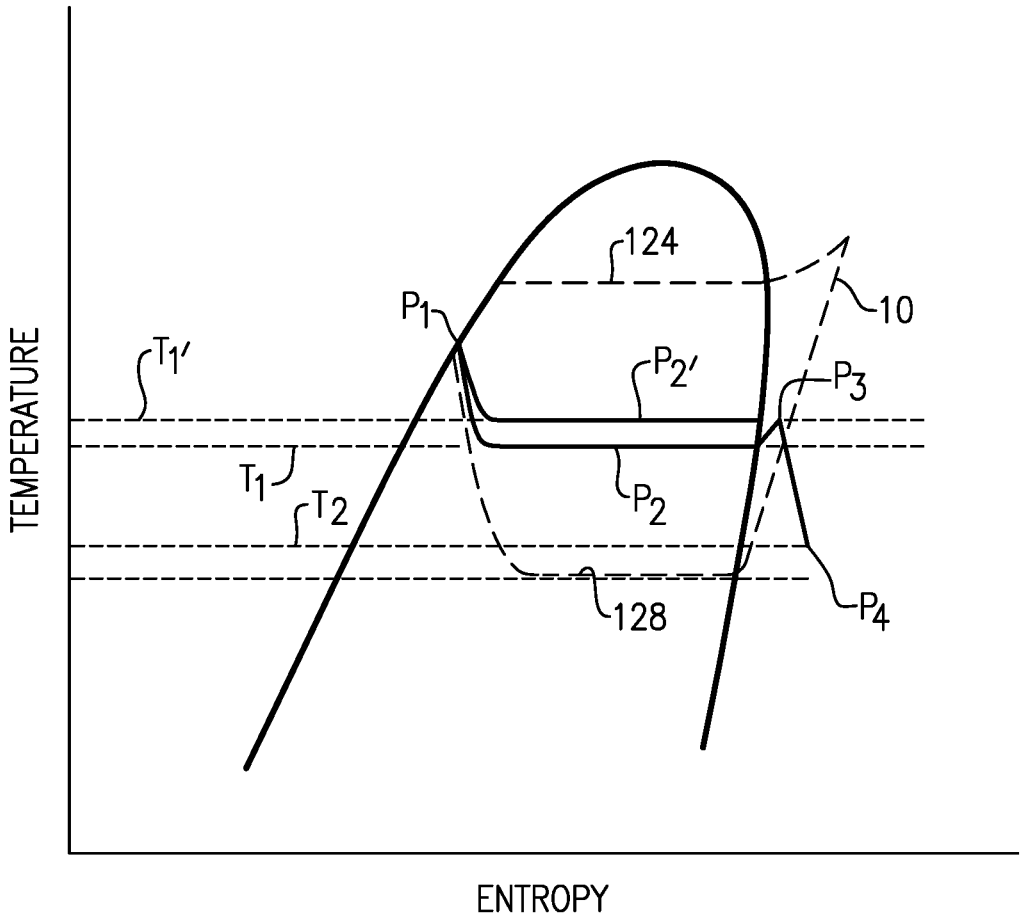
FIG. 7 is a plot of temperature versus entropy relative to the cooling circuit of FIG. 6.
Figure 8:
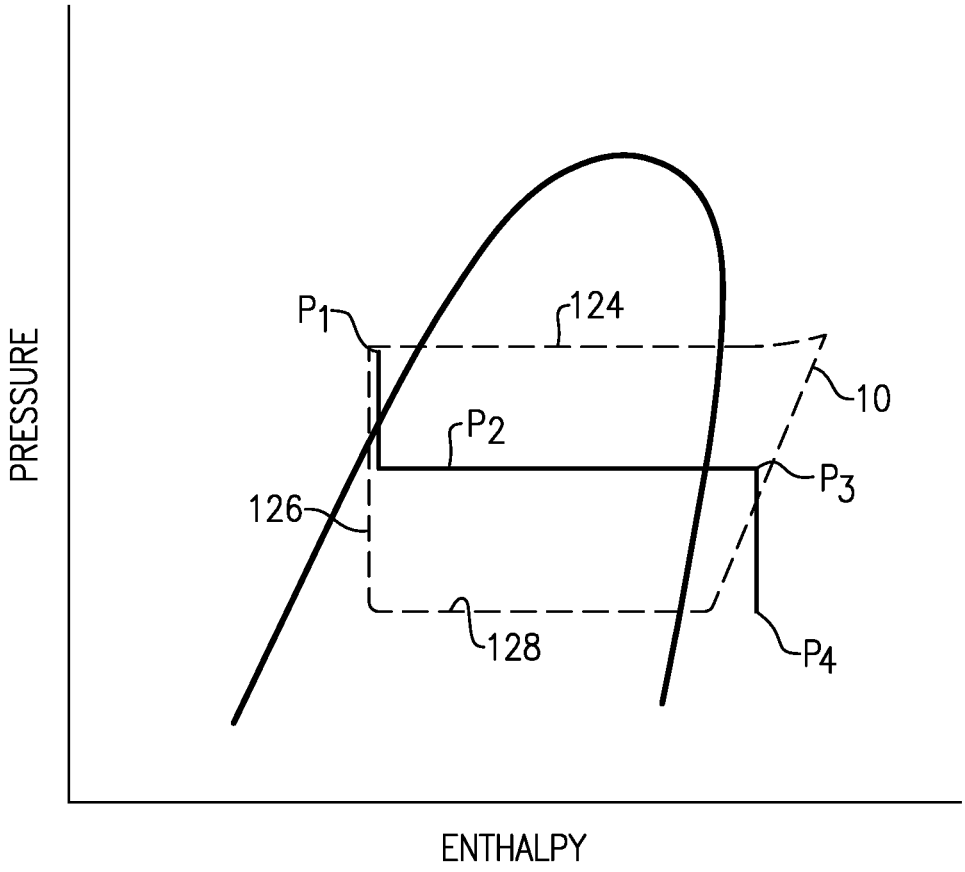
FIG. 8 is a plot of pressure versus enthalpy relative to the cooling circuit of FIG. 6.

The cooling circuit C provides an appropriate amount of refrigerant to the drive module 12 without forming condensation in the drive module 12. Condensation of water (i.e., water droplets) may form within the drive module 12 if the temperature of the drive module 12 falls below a certain temperature. This condensation may cause damage to the various electrical components within the drive module 12. The pressure regulator 134 is controlled to control the pressure of refrigerant within the heat exchanger 132, which in turn controls the saturated temperature of that refrigerant, such that condensation does not form within the drive module 12. The expansion of refrigerant as it passes through the pressure regulator 134 is represented at $P_3$ in FIGS. 7 and 8. Further, if an appropriate amount of refrigerant is provided to the heat exchanger 132 by the expansion valve 30, the refrigerant will absorb heat from the drive module 12 and be turned entirely into a vapor downstream of the heat exchanger 132, at point $P_4$.

During operation of the refrigerant loop 32, the temperature of the drive module 12 is continually monitored by a first temperature sensor $T_1$. In one example of this disclosure, the output of the first temperature sensor $T_1$ is reported to the controller 138. The controller 138 compares the output from the first temperature sensor $T_1$ to a target temperature $T_{TARGET}$. The target temperature $T_{TARGET}$ is representative of a temperature at which there will be no (or extremely minimal) condensation within the drive module 12. That is, $T_{TARGET}$ is above a temperature at which condensation is known to begin to form. In one example $T_{TARGET}$ is a predetermined value. In other examples, the controller 138 is configured to determine $T_{TARGET}$ based on outside temperature and humidity.

The controller 138 is further in communication with the pressure regulator 134, and is configured to command an adjustment of the pressure regulator 134 based on the output from the first temperature sensor $T_1$. The position of the pressure regulator 134 controls the temperature of the refrigerant within the heat exchanger 132. In general, during normal operation of the loop 32, the controller 138 maintains the position of the pressure regulator 134 such that the output from $T_1$ is equal to $T_{TARGET}$. However, if the output from $T_1$ decreases and falls below $T_{TARGET}$, the controller 138 commands the pressure regulator 134 to incrementally close (e.g., by 5%). Conversely, if the output from $T_1$ increases, the controller 138 commands the pressure regulator 134 to incrementally open.

Incrementally closing the pressure regulator 134 raises the temperature of the refrigerant within the heat exchanger 132, and prevents condensation from forming within the drive module 12. In one example, the controller 138 commands adjustment of the pressure regulator 34 until the output from $T_1$ returns to $T_{TARGET}$. Closing the pressure regulator 134 raises the output from $T_1$ and raises the pressure $P_2$, as illustrated graphically in FIG. 7 at $T_{1'}$ and $P_{2'}$.

Concurrent with the control of the pressure regulator 134, the controller 138 also controls the expansion valve 30 during operation. In this example the temperature and pressure of the refrigerant within the cooling circuit C downstream of the heat exchanger 132 are determined by a second temperature sensor $T_2$ and a pressure sensor $P_S$. In one example, the temperature sensor $T_2$ and the pressure sensor $P_S$ are located downstream of the pressure regulator 134. However, $T_2$ and $P_S$ could be located downstream of the heat exchanger 132 and upstream of the pressure regulator 134.

The outputs from the second temperature sensor $T_2$ and the pressure sensor $P_S$ are reported to the controller 138. The controller 138 is configured to determine (e.g., by using a look-up table) a level of superheat within the refrigerant downstream of the heat exchanger (e.g., at $P_4$). The controller 138 then compares the level of superheat within the refrigerant at $P_4$ and a superheat target value $SH_{TARGET}$. This comparison indicates whether an appropriate level of fluid was provided to the heat exchanger 132 by the expansion valve 30.

For example, the output from the second temperature sensor $T_2$ is compared to a saturation temperature $T_{SAT}$ at the pressure sensor output from the pressure sensor $P_S$. From this comparison, the controller 138 determines the level of superheat in the refrigerant. In one example, the controller 138 maintains the position of the expansion valve 30 such that the level of superheat exhibited by the refrigerant equals $SH_{TARGET}$. If the level of superheat exhibited by the refrigerant falls below $SH_{TARGET}$, the controller 138 will determine that too much fluid is provided to the heat exchanger 132 and will incrementally close the expansion valve 30. Conversely, the controller 138 will command the expansion valve 132 to incrementally open if the level of superheat exhibited by the refrigerant exceeds $SH_{TARGET}$.

This disclosure references an "output" from a sensor in several instances. As is known in the art, sensor outputs are typically in the form of a change in some electrical signal (such as resistance or voltage), which is capable of being interpreted as a change in temperature or pressure, for example, by a controller (such as the controller 138). The disclosure extends to all types of temperature and pressure sensors.

Further, while a single controller 138 is illustrated, the expansion valve 30 and pressure regulator 134 could be in communication with separate controllers. Additionally, the cooling circuit C does not require a dedicated controller 138. The functions of the controller 138 described above could be performed by a controller having additional functions. Further, the example control logic discussed above is exemplary. For instance, whereas in some instances this disclosure references the term "equal" in the context of comparisons to $T_{TARGET}$ and $SH_{TARGET}$, the term "equal" is only used for purposes of illustration. In practice, there may be an acceptable (although relatively minor) variation in values that would still constitute "equal" for purposes of the control logic of this disclosure.

The embodiments discussed above are simple enough to make oil free, centrifugal compressors economical for applications below 60 tons. Other known improvements of compressors, such as economizers 36 or variable speed drives, may be incorporated into the disclosed compressors 10 without causing the design to become prohibitively expensive to manufacture. It is to be noted that compressor housing 11*a* can be used as a heatsink for power components, like power semiconductors. Use of the compressor housing 11*a* as a heatsink further simplifies the structure and enhances reliability.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A centrifugal compressor, comprising:

a hermetically sealed exterior housing including a main housing, a first end cap attached to the main housing adjacent a first axial end of the main housing, and a second end cap attached to the main housing adjacent a second axial end of the main housing opposite the first axial end of the main housing, wherein the first end cap fully covers, when viewed along a central axis of the centrifugal compressor, the first axial end of the main housing and the second end cap fully covers, when viewed along the central axis, the second axial end of the main housing;

a drive module within the exterior housing, the drive module including a stator, a rotor, and oil free bearings; and an aero module within the exterior housing, the aero module having two centrifugal impellers driven by the drive module to compress a working fluid, wherein the centrifugal compressor is arranged such that a flow path for the working fluid is configured to direct the working fluid through the drive module before the working fluid reaches either of the two centrifugal impellers, wherein the flow path is provided within the exterior housing, wherein the first end cap includes a suction port, wherein the centrifugal compressor is arranged such that the working fluid flowing through the suction port flows along the flow path, and wherein the exterior housing includes a discharge port configured such that the working fluid expelled by the aero module exits the exterior housing by flowing through the discharge port in a radial direction perpendicular to the central axis, wherein the drive module is configured to rotatably drive a shaft, wherein both of the two centrifugal impellers are mounted adjacent a same end of the shaft, wherein the centrifugal compressor includes only a single aero module and both of the two centrifugal impellers are within the single aero module, wherein the two centrifugal impellers are configured such that the working fluid flows in series from a first of the two centrifugal impellers to a second of the two centrifugal impellers, wherein, before the working fluid reaches either of the two centrifugal impellers, the centrifugal compressor is arranged such that the flow path for the working fluid is configured to direct some of the working fluid along a gap between the rotor and the stator, and to direct some of the working fluid along an outside of the stator, wherein an electronics and power module is enclosed in an integrated electronics housing that is attached to the exterior housing, and wherein, relative to the flow path for the working fluid, the drive module is at least partially upstream of the electronics and power module and the centrifugal compressor is arranged such that the flow path for the working fluid is configured to direct the working fluid in a manner that the working fluid absorbs heat from the drive module before absorbing heat from the electronics and power module, wherein the integrated electronics housing projects radially outward from a radially outer surface of the exterior housing.

2. The centrifugal compressor of claim 1, wherein the oil free bearings are magnetic bearings.

3. The centrifugal compressor of claim 1, wherein the drive module is cooled by suction gas of the working fluid before the suction gas of the working fluid reaches an inlet of one of the two centrifugal impellers.

4. The centrifugal compressor of claim 1, wherein the drive module is driven by a variable frequency drive.

5. The centrifugal compressor of claim 4, wherein the variable frequency drive can drive the drive module to achieve system cooling capacities of between 15 and 60 tons.

6. The centrifugal compressor of claim 4, wherein the scaled exterior housing acts as a heatsink for power components of the variable frequency drive, and the working fluid cools the exterior housing.

7. The centrifugal compressor as recited in claim 1, wherein the main housing is attached to the first end cap by welds, and the main housing is also attached to the second end cap by welds.

8. The centrifugal compressor as recited in claim 1, wherein the suction port is fluidly coupled to a main flow path and a port in the main housing is fluidly coupled to an economizer flow path.

9. The centrifugal compressor as recited in claim 8, wherein the second end cap does not include any ports configured to permit fluid to enter or exit the exterior housing.

10. The centrifugal compressor as recited in claim 1, wherein the working fluid flowing through the drive module is configured to flow radially around the both of the two centrifugal impellers before being compressed by the aero module.

11. The centrifugal compressor as recited in claim 1, wherein the centrifugal compressor is a centrifugal refrigerant compressor configured for use in a refrigerant system.

12. The centrifugal compressor as recited in claim 1, wherein:

the first end cap includes a first planar surface lying in a first plane normal to the central axis and a first axially-extending projection projecting from the first planar surface toward the main housing, the second end cap includes a second planar surface lying in a second plane normal to the central axis and a second axially-extending projection projecting from the second planar surface toward the main housing, the first planar surface fully covers the first axial end of the main housing when viewed along the central axis from a first location exterior to the centrifugal compressor, the first location is spaced-apart from the first end cap in a direction opposite the main housing, the second planar surface fully covers the second axial end of the main housing when viewed along the central axis from a second location exterior to the centrifugal compressor, and the second location is spaced-apart from the second end cap in a direction opposite the main housing.

13. The centrifugal compressor as recited in claim 12, wherein at least one port configured to communicate the working fluid into or out of the centrifugal compressor is formed in at least one of the first axially-extending projection and the second axially-extending projection.

14. The centrifugal compressor as recited in claim 1, wherein both of the two centrifugal impellers face a same direction.

15. The centrifugal compressor as recited in claim 14, wherein the two centrifugal impellers have inlets facing away from the drive module.

16. The centrifugal compressor as recited in claim 1, wherein the flow path is arranged such that the working fluid flows radially around the aero module before entering the aero module from a side opposite the drive module.

* * * * *